US010517369B2

(12) United States Patent
Hori

(10) Patent No.: US 10,517,369 B2
(45) Date of Patent: Dec. 31, 2019

(54) DRAWING APPARATUS AND CONTROL METHOD OF DRAWING APPARATUS

(71) Applicant: CASIO COMPUTER CO., LTD., Tokyo (JP)

(72) Inventor: Masahiro Hori, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 635 days.

(21) Appl. No.: 15/148,803

(22) Filed: May 6, 2016

(65) Prior Publication Data

US 2016/0367011 A1 Dec. 22, 2016

(30) Foreign Application Priority Data

Jun. 22, 2015 (JP) ..... 2015-124910

(51) Int. Cl.
*A45D 29/22* (2006.01)
*A45D 29/00* (2006.01)

(52) U.S. Cl.
CPC ..... *A45D 29/22* (2013.01); *A45D 29/00* (2013.01); *A45D 2029/005* (2013.01)

(58) Field of Classification Search
CPC ... A45D 29/22; A45D 29/00; A45D 2029/005
See application file for complete search history.

(56) References Cited

U.S. PATENT DOCUMENTS 7,083,573 B2 * 8/2006 Yamakoshi ..... A61B 5/02233 600/485
7,290,550 B2 * 11/2007 Sim ..... G07F 17/26 101/35
2003/0030541 A1 * 2/2003 Tokorotani ..... A61B 5/1172 340/5.52

(Continued)

FOREIGN PATENT DOCUMENTS

JP H06-11701 U 2/1994
JP 2000-194838 A 7/2000

(Continued)

OTHER PUBLICATIONS

Translation of JP 2001-314226 retrieved from https://www4.j-platpat.inpit.go.jp/eng/tokujitsu/tkbs_en/TKBS_EN_GM301_Detailed.action on Oct. 24, 2018 (Year: 2001).*

(Continued)

*Primary Examiner* — Heidi M Eide
(74) *Attorney, Agent, or Firm* — Fitch, Even, Tabin & Flannery LLP

(57) ABSTRACT

A drawing apparatus and a control method of a drawing apparatus that can suppress the movement of a finger inserted in a finger insertion section more reliably and also hold the finger more softly are provided. The drawing apparatus includes: a finger holding case including a finger insertion section in which a finger is inserted and an opening through which the nail of the finger is exposed at the position facing a drawing head section; and a finger holding section located in the finger holding case and including an annular (Continued)

section, wherein a fluid is supplied to the annular section to circumferentially press the finger and suppress the movement of the finger, and the fluid is discharged from the annular section to release the press.

18 Claims, 5 Drawing Sheets

(56) References Cited

U.S. PATENT DOCUMENTS

2012/0147113 A1* 6/2012 Yamasaki ..... A45D 29/00
347/104

FOREIGN PATENT DOCUMENTS

JP 2001-314226 A 11/2001
JP 2012-152410 A 8/2012

OTHER PUBLICATIONS

Chinese Office Action dated May 31, 2017, issue in corresponding Chinese Patent Application No. 201610237098.1 and English translation of the same. (18 pages).
JPO; Application No. 2015-124910; Notice of Reasons for Refusal dated Aug. 6, 2019.

* cited by examiner

DRAWING APPARATUS AND CONTROL METHOD OF DRAWING APPARATUS

CROSS-REFERENCE TO RELATED APPLICATIONS

This application is based upon and claims the benefit of priority from the prior Japanese Patent Application No. 2015-124910, filed Jun. 22, 2015, the entire contents of which are incorporated herein by reference.

BACKGROUND OF THE INVENTION

1. Field of the Invention

The present invention relates to a drawing apparatus and a control method of a drawing apparatus.

2. Description of the Related Art

Techniques have been conventionally proposed that, in a drawing apparatus for drawing nail designs on fingernails, hold the finger of the nail subjected to the drawing.

Japanese Patent Application Laid-Open No. 2000-194838 discloses a nail art apparatus including a holder for locking a finger. The holder includes a moving section on which a finger is placed and a pair of bladed support members that operate simultaneously with the moving section. When the user places the finger on the moving section and the moving section moves downward, the pair of support members approach each other, thus holding the finger placed on the moving section.

However, since the holder in Japanese Patent Application Laid-Open No. 2000-194838 mechanically holds the finger by operating the moving section, the support members, and the like, its structure is complex, and also gently holding the finger is not taken into consideration.

In view of this, the following structure has been studied: A cushion or a spring is provided on the pulp side (lower side) of the finger inserted in the finger insertion section as a member that softly touches the finger, and the reaction force of the cushion or spring is used to press the nail side (upper side) part of the finger other than the nail against the upper wall of the finger insertion section, thus suppressing the movement of the finger.

Given the differences in thickness (diameter) and shape of the finger among users, however, the structure of simply pressing the finger against the upper wall of the finger insertion section with the reaction force of the cushion or spring may be unable to hold the finger adequately. The structure of pressing the finger against the upper wall by the cushion or the like also has a problem in that the finger easily moves from side to side. Besides, such a structure that keeps the finger from directly touching the upper wall may be needed from the viewpoint of holding the finger more gently.

The present invention has been developed in view of such circumstances, and has an object of providing a drawing apparatus and a control method of a drawing apparatus that can suppress the movement of a finger inserted in a finger insertion section more reliably and also hold the finger more softly.

SUMMARY OF THE INVENTION

To solve the stated problem, a drawing apparatus according to the present invention includes: a holding case including an insertion section in which a finger or toe is inserted and an opening through which a nail of the finger or toe is exposed at a position facing a drawing head section; and a holding section located in the holding case and including an annular section, wherein the annular section circumferentially presses the finger or toe and suppresses movement of the finger or toe by supplying of a fluid to the annular section.

According to the present invention, it is possible to provide a drawing apparatus and a control method of a drawing apparatus that can suppress the movement of a finger or toe inserted in an insertion section more reliably and also hold the finger or toe more softly.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
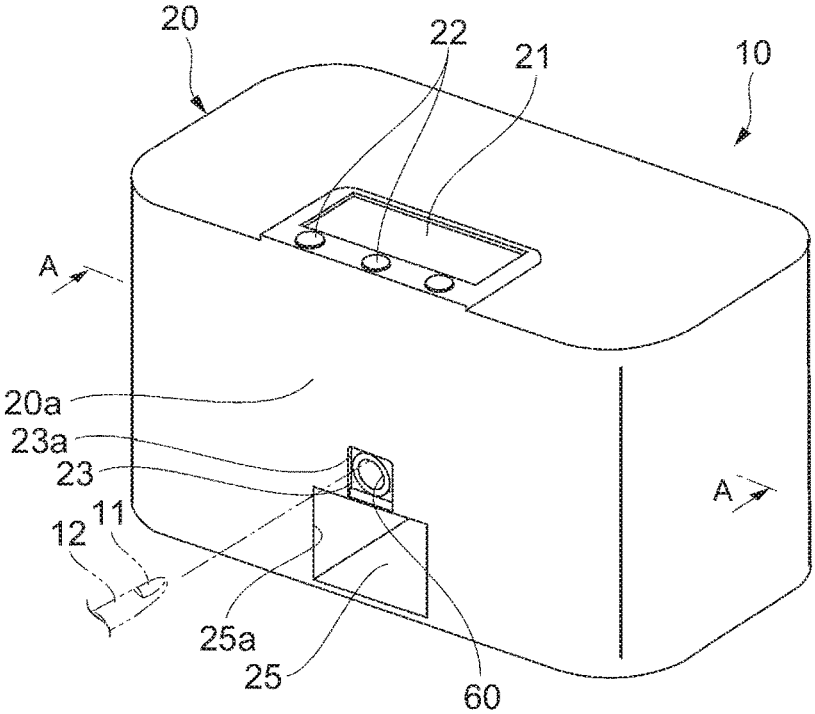
FIG. 1 is a perspective view illustrating the appearance of a drawing apparatus according to an embodiment.

A mode for carrying out the present invention (hereinafter referred to as an "embodiment") is described in detail below, with reference to the accompanying drawings. Throughout the description of the embodiments, the same elements are given the same reference signs.

Although the following embodiments assume that the drawing apparatus performs drawing on the surface of a fingernail, the surface subjected to drawing according to the present invention is not limited to the surface of a fingernail, but may be the surface of a toenail as an example.

First Embodiment

A first embodiment of the drawing apparatus according to the present invention is described below, with reference to FIGS. 1 to 4.

As illustrated in FIG. 1, a drawing apparatus 10 has a drawing function, and draws a nail design on a nail 11 of a human finger 12. The drawing apparatus 10 includes a box-shaped housing 20. A display section 21 and an operation section 22 are provided on the upper surface (top board) of the housing 20. An insertion opening 23*a* of a first finger insertion section 23 (first insertion section 23) is formed at the lower center of a front part 20*a* of the housing 20, and also an insertion opening 25*a* of a second finger insertion section 25 (second insertion section 25) is formed below the first finger insertion section 23. The second finger insertion section 25 is a space that is formed from the front part 20*a* of the housing 20 toward the back and into which other fingers of the same hand as the finger 12 subjected to drawing are inserted. The second finger insertion section 25 is a space separated from (not communicating with) the internal space of the housing 20.

Figure 2:
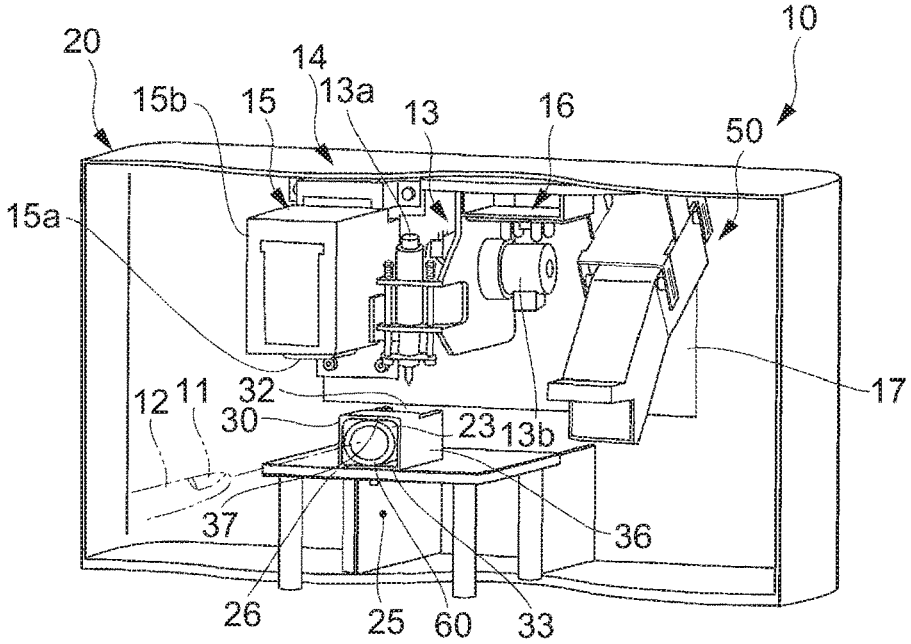
FIG. 2 is a sectional view of a housing along line A-A in FIG. 1.

As illustrated in FIG. 2, a finger placement table 26 (placement table 26) is provided at the bottom in the housing 20, and a finger holding case 30 (holding case 30) is set on the upper surface of the finger placement table 26. The internal space of the finger holding case 30 is a space for forming the first finger insertion section 23, and a finger holding section 60 (holding section 60) is located in this space.

A fixing plate 17 is installed in the housing 20 so as to be movable in the apparatus width direction and apparatus depth direction. A drawing section 14 including a drawing head section 13 and an inkjet section 15 is fixed to one of the right and left of the fixing plate 17 (the left in this example), and a drier 50 for drying the ink applied to the nail 11 by hot air is fixed to the other one of the right and left of the fixing plate 17 (the right in this example). An image acquisition section 16 for recognizing the position and shape of the nail 11 is placed between the drawing section 14 and the drier 50. FIG. 2 illustrates the inside of the apparatus when the drawing head section 13 has been moved to the position directly above an opening 32 (described later) of the finger holding case 30.

The drawing head section 13 includes a pen 13*a* for performing drawing on the nail 11, and is movable integrally with the fixing plate 17 in the apparatus width direction and the apparatus depth direction and also movable up and down by driving means 13*b* such as a stepping motor. The drawing head section 13, after moving to the position directly above the opening 32 of the finger holding case 30, applies a base coat or the like on the surface of the nail 11 with the pen tip of the pen 13*a* lowered to touch the surface of the nail 11.

The inkjet section 15 includes an inkjet head 15*a* and an inkjet cartridge 15*b*, and prints a nail design onto the nail 11 by the inkjet head 15*a*. The inkjet section 15 is movable integrally with the fixing plate 17 in the apparatus width direction and the apparatus depth direction, and moves to the position directly above the opening 32 of the finger holding case 30 and draws a desired design on the surface of the nail 11 with the inkjet head 15*a*.

Figure 3:
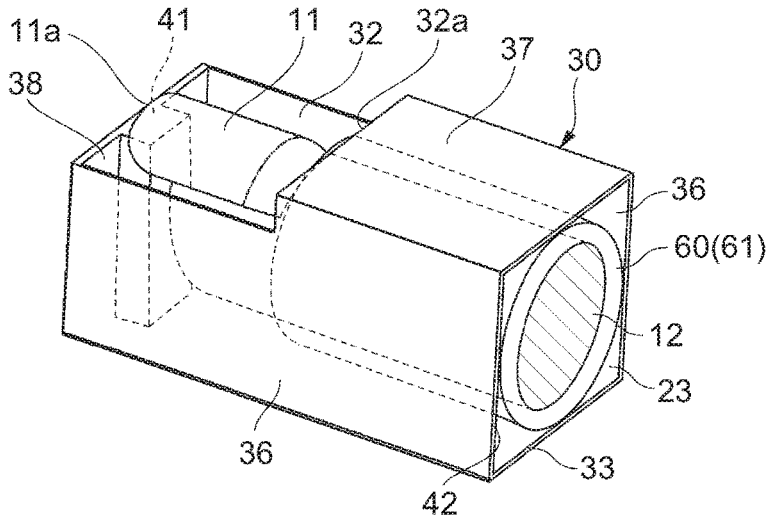
FIG. 3 is a perspective view of the structure of a first finger insertion section and its surroundings according to a first embodiment.

As illustrated in FIG. 3, the finger holding case 30 has a lower wall 33 fixed to the finger placement table 26 (see FIG. 2). The finger holding case 30 also has: right and left side walls 36 formed upward respectively from the right and left edges of the lower wall 33; an upper wall 37 connecting the upper edges of the right and left side walls 36 in the part closer to the front side in the finger insertion direction (hereafter simply referred to as the "front side"); a back wall 38 connecting the edges of the right and left side walls 36 on the back side in the finger insertion direction (hereafter simply referred to as the "back side"); and a nail placement table 41 that is erected along the inner surface of the back wall 38 and on which a distal edge 11*a* at the tip of the nail 11 is placed. The upper part of the finger holding case 30 closer to the back side has an opening 32 through which the nail 11 of the inserted finger 12 is exposed upward. The opening 32 is formed so as to expose the nail 11 at the position facing the drawing head section 13. FIG. 3 illustrates a state where the nail 11 of the finger 12 inserted in the first finger insertion section 23 of the finger holding case 30 is visible from above through the opening 32.

Figure 4:
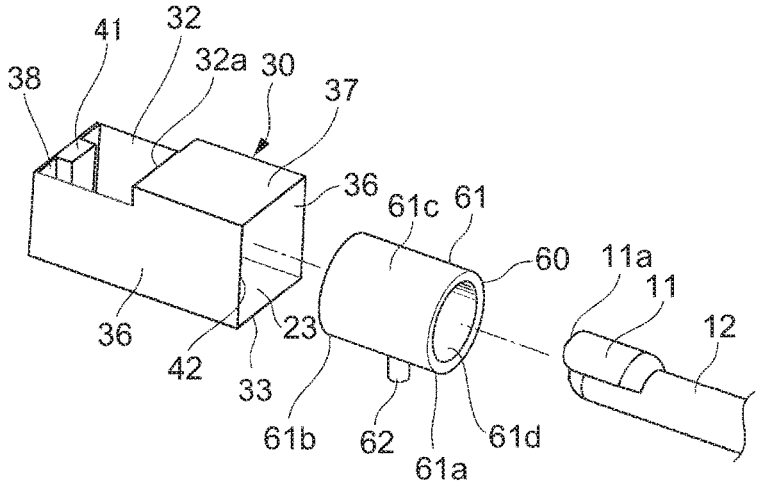
FIG. 4 is an exploded perspective view of the structure of the first finger insertion section and its surroundings in FIG. 3.

As illustrated in FIG. 4, the finger holding section 60 circumferentially presses the finger 12 and suppresses the movement of the finger 12 by being supplied with a fluid, and releases the press by discharging the supplied fluid, in a state where the finger 12 is inserted at an accurate position. The finger holding section 60 includes an annular section 61 in which the finger 12 is inserted, and a fluid supply and discharge section 62 through which the fluid is supplied and discharged.

The annular section 61 has a front axial end 61*a* at or near a front opening 42 of the finger holding case 30, and a back axial end 61*b* at or near a front edge 32*a* of the opening 32 of the finger holding case 30. The annular section 61 has a hollow shape, and at least a part of its outer circumferential surface 61*c* is attached to the inner surface of the finger holding case 30. When the fluid is supplied to the inside of the annular section 61, the annular section 61 expands and circumferentially presses the finger 12 softly with its cushioning effect. When the fluid is discharged from the inside (the hollow portion), the annular section 61 contracts.

The annular section 61 is preferably composed of a sheet having rigidity (shape retainability) that can maintain such an annular shape that allows the insertion of the finger 12 in its inner circumferential surface 61*d* even in the contracted state. The material of the sheet forming the annular section 61 may be any of various resin materials and various rubber materials. Examples of the suitable material include polyurethane, nitrile rubber, propylene rubber, silicone rubber, and natural rubber.

The fluid supply and discharge section 62 projects downward from the lower part of the outer circumferential surface 61*c* of the annular section 61, and supplies and discharges the fluid to and from the inside of the annular section 61. The fluid supply and discharge section 62 may be a member formed separately from the annular section 61, or formed integrally with the annular section 61. In this example, the fluid supply and discharge section 62 is formed integrally with the annular section 61, in the lower part of the annular section 61 at the axial center. The fluid supply and discharge section 62 is fitted into a notch or through hole (not illustrated) formed in the finger holding case 30.

The fluid may be any type of fluid that can be supplied to and discharged from the inside of the annular section 61 through the fluid supply and discharge section 62, and is selectable from various gases and liquids. For example, air is suitable as the fluid.

In this drawing apparatus 10, when the finger 12 is inserted into the first finger insertion section 23 of the finger holding case 30 and, for example, a switch (not illustrated) provided on the drawing apparatus 10 is turned on, the fluid is supplied to the inside of the annular section 61 through the fluid supply and discharge section 62, and the annular section 61 expands between the finger 12 and the finger holding case 30 until a predetermined pressure is reached. The expanded annular section 61 fits the inserted finger 12, and presses/holds the finger 12 so as to envelop the whole circumference of the finger 12, thus suppressing the movement of the finger 12 in the first finger insertion section 23. In this state where the movement of the finger 12 is suppressed, a nail design is drawn on the nail 11 by the drawing head section 13 or the inkjet section 15 through the opening 32. After the drawing on the nail 11 ends, the fluid is discharged from the inside of the annular section 61 through the fluid supply and discharge section 62, to release the press of the annular section 61 on the finger 12.

(Advantageous Effects of the First Embodiment)

According to the first embodiment described above, the annular section 61 presses/holds the finger 12 so as to envelop the whole circumference of the finger 12 with the inner circumferential surface 61*d* of the annular section 61, so that the movement of the finger 12 from side to side and up and down can be suppressed favorably. Moreover, since the annular section 61 expanded by the fluid softly touches the whole circumference of the inserted finger 12, not only the movement of the finger 12 inserted in the first finger insertion section 23 can be suppressed more reliably but also the finger 12 can be held with a softer and more comfortable feel.

Second Embodiment

A second embodiment of the drawing apparatus according to the present invention is described below, with reference to FIGS. 5 to 8. The same elements as those in the foregoing first embodiment are given the same reference signs, and their repeated description is omitted.

Figure 5:
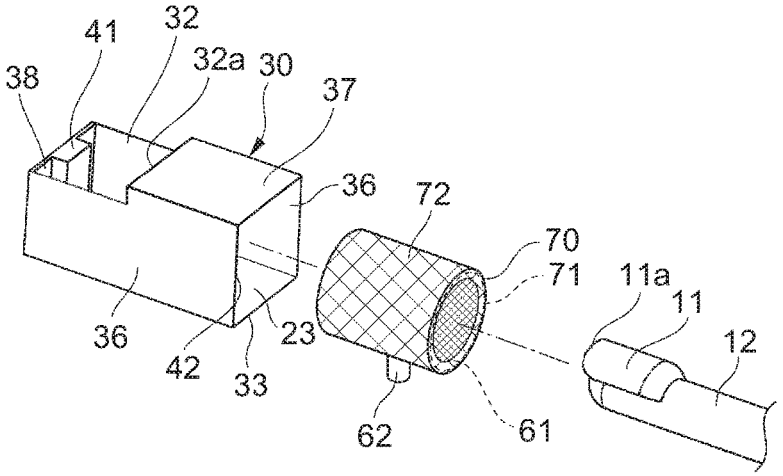
FIG. 5 is an exploded perspective view of the structure of the first finger insertion section and its surroundings according to a second embodiment.

As illustrated in FIG. 5, a finger holding section 70 according to the second embodiment includes a first support section 71 and a second support section 72 for supporting the annular section 61 in order to maintain the annular shape of the annular section 61 in the case where the annular section 61 has difficulty in maintaining the annular shape by itself, in the state where the fluid is not supplied (the contracted state).

Figure 6:
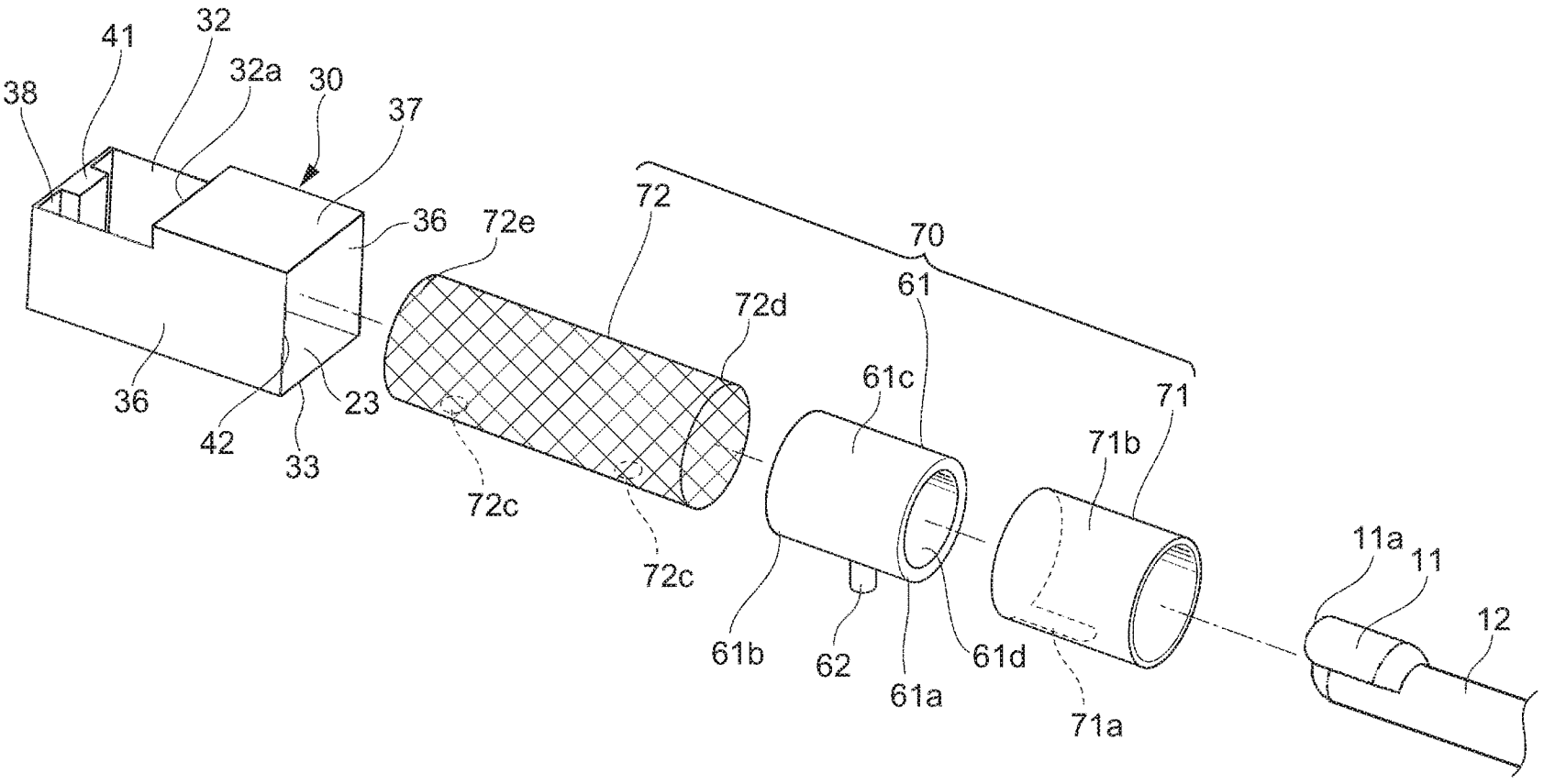
FIG. 6 is an exploded perspective view of a finger holding section in FIG. 5.

As illustrated in FIG. 6, the first support section 71 is an annular member that is fitted onto the outer circumferential surface 61*c* of the annular section 61 and has higher rigidity than the annular section 61. The first support section 71 has substantially the same axial length as the annular section 61. The first support section 71 has a notch 71*a* through which the fluid supply and discharge section 62 extends. For example, the notch 71*a* is open at the back end of the first support section 71. The first support section 71 may be made of any of various resin materials and various rubber materials. For example, a tube made of silicone rubber is suitable as the first support section 71.

Figure 7:
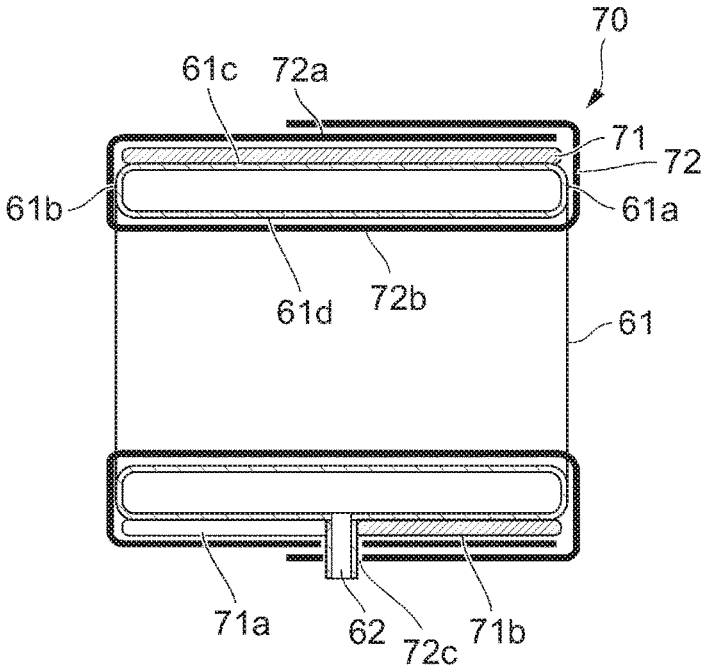
FIG. 7 is a sectional view of the finger holding section in FIG. 5.

As illustrated in FIG. 7, the second support section 72 is a cylindrical body made of an elastic material (e.g. a net member), and is formed as at least a double cylinder to cover the outer circumferential surface 71*b* of the first support section 71 and the inner circumferential surface 61*d* of the annular section 61 so that the first support section 71 and the annular section 61 can be held integrally. In detail, the second support section 72 has an outer portion 72*a* that clamps the outer circumferential surface 71*b* of the first support section 71 and an inner portion 72*b* that supports the inner circumferential surface 61*d* of the annular section 61, and sandwiches the first support section 71 and the annular section 61 in their thickness direction by the outer portion 72*a* and the inner portion 72*b*. The second support section 72 has a clearance hole 72*c* through which the fluid supply and discharge section 62 extends, at the position corresponding to the fluid supply and discharge section 62.

An example of the method of assembling the finger holding section 70 composed of the first support section 71, the second support section 72, and the annular section 61 is described below, with reference to FIG. 8.

Figure 8:
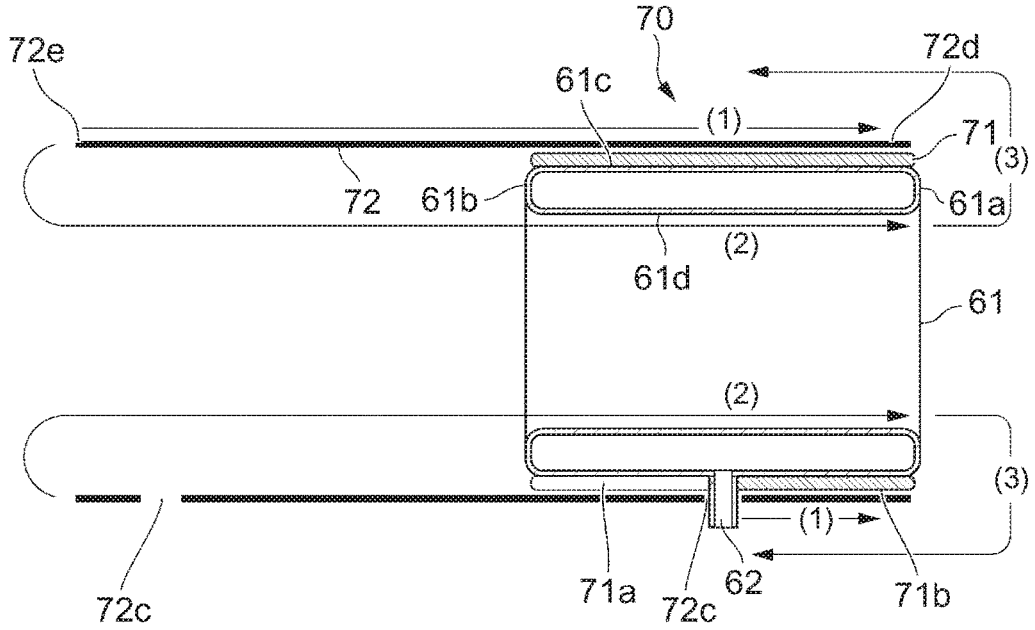
FIG. 8 is a diagram for describing how to assembling the finger holding section in FIG. 7.

As illustrated in FIG. 8, first the first support section 71 is fitted onto the outer circumferential surface 61*c* of the annular section 61 so as to insert the fluid supply and discharge section 62 into the notch 71*a*, and then one end 72*d* of the second support section 72 is attached to the outer circumferential surface 71*b* of the first support section 71 (arrow (1)). Here, the fluid supply and discharge section 62 is fitted into the clearance hole 72*c*. Following this, the remaining unattached part of the second support section 72 is, for example, passed along the inner circumferential surface 61*d* of the annular section 61 from the axial end 61*b* of the annular section 61 (arrow (2)), and taken out of the axial end 61*a* of the annular section 61 and folded back on the outer circumferential surface 61*c* side of the annular section 61 (arrow (3)). The other end 72*e* which has been folded is overlaid on the outside of the already attached end 72*d*, and the fluid supply and discharge section 62 is fitted into another clearance hole 72*c*, thus hooking the other end 72*e*.

In the finger holding section 70 assembled in this way (FIG. 7), the first support section 71 maintains the shape (cylindrical shape) of the outer circumferential surface 61*c* of the annular section 61, and the second support section 72 supports the annular section 61 by pressing the annular section 61 from the inner circumferential surface 61*d* against the first support section 71. Hence, even in the state where the fluid is not supplied (the contracted state), the shape of the inner circumferential surface 61*d* of the annular section 61 is maintained to be a cylinder into which the finger 12 can be inserted.

According to the second embodiment described above, not only the movement of the finger 12 inserted in the first finger insertion section 23 can be suppressed more reliably and the finger 12 can be held more softly as in the first embodiment, but also the shape (annular shape) of the annular section 61 can be maintained stably by the first support section 71 and the second support section 72 even in the state where the fluid is not supplied (the contracted state). Thus, even in the case where, in the contracted state, the annular section 61 has difficulty in maintaining the shape (annular shape) by itself due to its own weight or the like because, for example, the annular section 61 is made of a relatively soft material, the finger 12 can be easily and smoothly inserted into the first finger insertion section 23 whose annular shape is maintained by the first support section 71 and the second support section 72.

(Modification of the Annular Section)

A modification of the annular section according to the first and second embodiments is described below, with reference to FIGS. 9 and 10.

Figure 9:
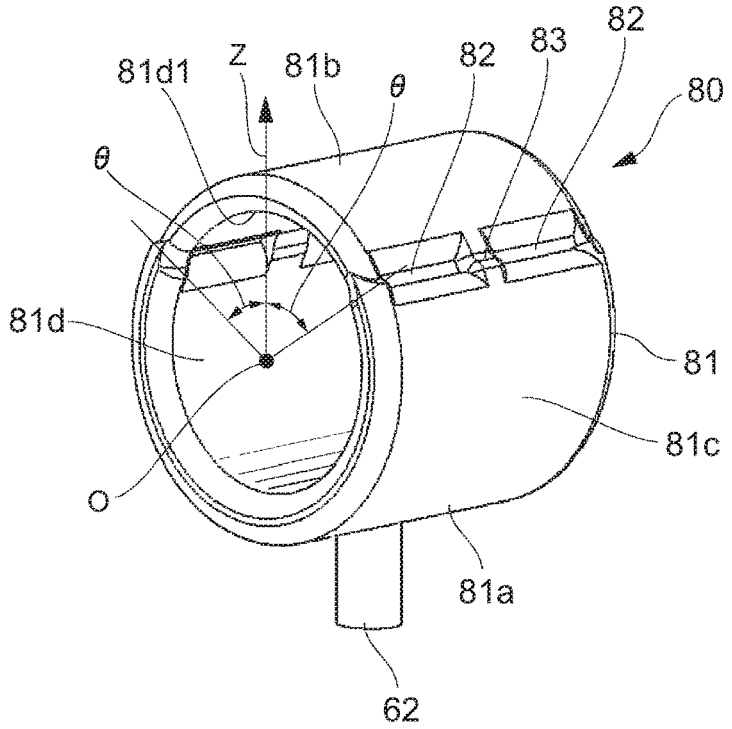
FIG. 9 is a perspective view of a modification of an annular section according to the first and second embodiments.

In this modification, an annular section 81 of a finger holding section 80 has a structure in which an upper portion 81*b* expands less than a lower portion 81*a* when the fluid is supplied to the inside, as illustrated in FIG. 9. In detail, in this example, a plurality of crushed sections 82 are formed by partly crushing and welding together the facing walls of the outer circumferential surface 81*c* and inner circumferential surface 81*d* of the annular section 81, at each of upper symmetrical positions on the right and left sides each at an acute angle θ (approximately 60° in FIG. 9) with respect to a vertical axis Z in the state where the annular section 81 is contracted. Here, the vertical axis Z extends vertically upward from an origin O which is the annular center of the annular section 81. Thus, in the modification illustrated in FIG. 9, the upper portion 81*b* is the upper area of approximately 120° about the annular center of the annular section 81, and the lower portion 81*a* is the remaining area, i.e. the lower area of approximately 240° about the annular center of the annular section 81. A communication section 83 that communicates between the lower portion 81*a* and the upper portion 81*b* and has a smaller flow path cross-sectional area is formed between the plurality of crushed sections 82. In this modification, the communication section 83 with a smaller flow path cross-sectional area makes the upper portion 81*b* smaller in capacity than the lower portion 81*a*, so that the upper portion 81*b* expands less than the lower portion 81*a* to which the fluid supply and discharge section 62 is connected. In other words, given that the annular section 81 of the finger holding section 80 expands between the finger 12 and the inner wall of the finger holding case 30 until a predetermined pressure is reached, the lower portion 81*a* having a larger capacity expands more than the upper portion 81*b* having a smaller capacity to which the fluid is supplied via the communication section 83 with a smaller cross-sectional area (narrower flow path).

Figure 10:
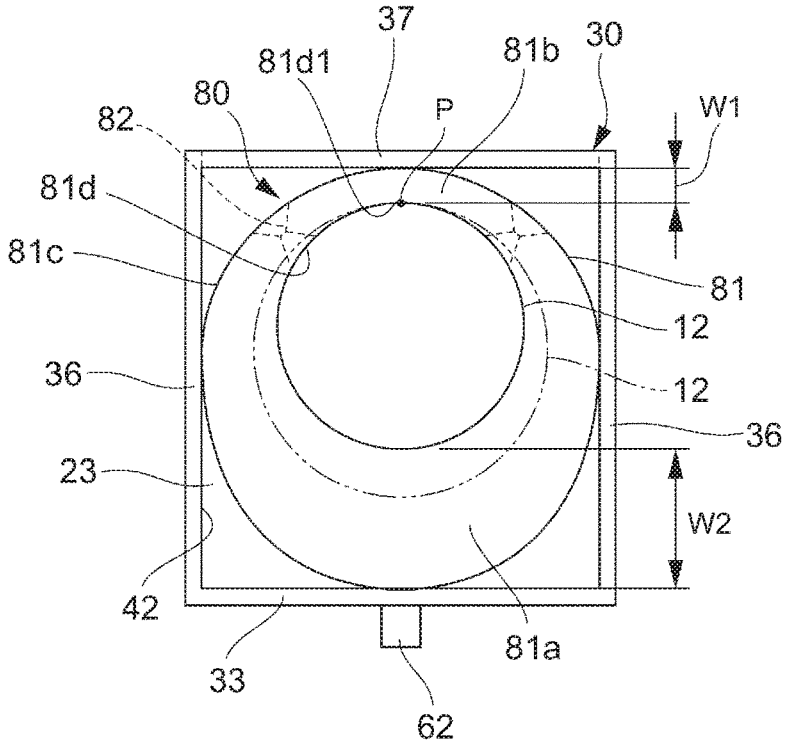
FIG. 10 is a diagram for describing the operation of the annular section in FIG. 9.

FIG. 10 is a diagram for describing the operation of the annular section 81 in FIG. 9, and is a front view of the finger holding case 30 and the finger holding section 80. As illustrated in FIG. 10, the upper portion 81*b* (facing the back of the inserted finger) expands less than the lower portion 81*a* (facing the pulp of the inserted finger). As a result, the width W1 in the height direction of the upper portion 81*b* of the annular section 81 is kept constant regardless of the thickness (diameter) and shape of the finger 12, whereas the width W2 in the height direction of the lower portion 81*a* of the annular section 81 which extends more easily changes depending on the thickness (diameter) and shape of the finger 12. Thus, the upper edge of the finger 12 is positioned at the upper edge 81*d*1 of the inner circumferential surface 81*d* of the annular section 81 regardless of the thickness (diameter) and shape of the finger 12, and so the height position of the nail 11 is fixed.

For example, in the case where a thin finger 12 (designated by the solid line in FIG. 10) is inserted and the annular section 81 is expanded, first the upper edge of the finger 12 is positioned at the upper edge 81*d*1 of the inner circumferential surface 81*d* of the annular section 81, and then the lower portion 81*a* of the annular section 81 expands to a relatively large extent between the lower edge of the finger 12 and the lower wall 33 due to the thinness of the finger 12, as a result of which the thin finger 12 is held securely. In the case where a thick finger 12 (designated by the chain double-dashed line in FIG. 10) is inserted and the annular section 81 is expanded, first the upper edge of the finger 12 is positioned at the upper edge 81*d*1 of the inner circumferential surface 81*d* of the annular section 81, and then the lower portion 81*a* of the annular section 81 expands to a relatively small extent between the lower edge of the finger 12 and the lower wall 33 due to the thickness of the finger 12, as a result of which the thick finger 12 is held securely. In this way, the finger 12 is held securely while the position P of the upper edge of the finger 12 inserted in the first finger insertion section 23 and the height position of the nail 11 are kept constant, regardless of the thickness (diameter) of the finger 12.

In the case where the annular section has a structure in which the upper portion expands to the same extent as or more than the lower portion, on the other hand, the upper portion of the annular section expands differently depending on the thickness (diameter) of the finger 12, causing the height position of the upper edge of the finger 12 and the nail 11 to change depending on the thickness (diameter) of the finger 12. In detail, when the nail placement table 41 is not present or is not used, the nail 11 is higher than the opening 32 in the case where the finger 12 is thick, and lower than the opening 32 in the case where the finger 12 is thin. This may hinder accurate drawing of a nail design on each nail 11. Besides, when the distal edge 11*a* is placed on the nail placement table 41, the nail 11 tilts in the case where the finger 12 is thin. This may hinder accurate drawing of a nail design on each nail 11.

With the annular section 81 (see FIG. 10), however, the height position P of the upper edge (back) of the finger 12 inserted in the first finger insertion section 23 and the height position of the nail 11 can be kept (substantially) constant regardless of the thickness (diameter) and shape of the finger 12. This enables more accurate drawing of a nail design on the nail 11. Especially when the inkjet section 15 in the drawing section 14 draws a nail design on the nail 11, keeping the distance between the inkjet head 15*a* and the nail 11 at substantially a predetermined distance (preferably about 1 mm to 2 mm) is essential for high-resolution and accurate drawing of the nail design on the nail.

The structure for causing the upper portion 81*b* to expand less than the lower portion 81*a* in the annular section 81 is not limited to decreasing the cross-sectional area of the flow path of the communication section 83. For example, a sheet forming the upper portion 81*b* may be less expandable than a sheet forming the lower portion 81*a*. The less expandable upper portion 81*b* is obtained by making the sheet forming the upper portion 81*b* from a less expandable hard material than the sheet forming the lower portion 81*a*, or by making the sheet forming the upper portion 81*b* thicker than the sheet forming the lower portion 81*a*.

While some embodiments of the present invention have been described above, the scope of the present invention is not limited to these embodiments, but includes the scope of the invention set forth in the claims and its equivalent scope.

What is claimed is:

1. A finger or toe holder for a drawing apparatus comprising:

a holding case including an insertion section having at least one wall defining a space for receiving a finger or toe inserted therein and an opening through which a nail of the received finger or toe is exposed at a position facing a drawing head section; and a holding section located at the space in the holding case and including an annular section having a hollow opening for receiving the finger or toe therein, a nail placement table in the opening of the holding case and disposed for supporting a tip of the nail thereon;

wherein an inner surface of the annular section facing the hollow opening is for pressing the finger or toe received in the hollow opening and suppressing movement of the finger or toe when fluid is supplied to the annular section, wherein when the nail of the finger or toe is exposed at the opening of the holding case and the tip of the nail is supported on the nail placement table, the finger or toe received in the hollow opening faces a specified portion of the inner surface of the annular section and the fluid is supplied to the annular section, the annular section expands in a generally inward direction in the hollow opening except for the specified portion of the inner surface of the annular section, such that a distance between the nail of the finger or toe at the opening of the holding case and the drawing head section is maintained substantially constant regardless of a diameter of the finger or toe.

2. The finger or toe holder for a drawing apparatus according to claim 1, wherein when the fluid is supplied to the annular section, the annular section expands in a generally inward direction in the hollow opening except for the specified portion until an inner pressure of the annular section reaches a predetermined value, for circumferentially pressing the finger or toe and suppressing the movement of the finger or toe.

3. The finger or toe holder for a drawing apparatus according to claim 1, wherein the annular section further comprises a plurality of crushed sections that do not allow for fluid communication therethrough and which are located above an annular center of the annular section, and the annular section further comprises a communication section that does allow for a fluid communication therethrough and which is located between the plurality of crushed sections.

4. The finger or toe holder for a drawing apparatus according to claim 1, wherein the annular section includes an upper portion having the specified portion and a lower portion below the upper portion, and when the fluid is supplied to the annular section, the expansion of the upper portion in the hollow opening is less than the expansion of the lower portion in the hollow opening.

5. The finger or toe holder for a drawing apparatus according to claim 4, wherein a sheet forming the upper portion of the annular section is less expandable than a sheet forming the lower portion of the annular section.

6. The finger or toe holder for a drawing apparatus according to claim 1, wherein the holding section includes a support section that supports the annular section to maintain an annular shape of the annular section even in a state where the fluid is not supplied to the annular section.

7. The finger or toe holder for a drawing apparatus according to claim 1, wherein at least a part of an outer circumferential surface of the annular section is attached to an inner surface of the holding case.

8. The finger or toe holder for a drawing apparatus according to claim 1, wherein when the fluid is discharged from the annular section, the annular section no longer presses the nail of the finger or toe received in the hollow opening of the annular section.

9. The finger or toe holder for a drawing apparatus according to claim 8, wherein the holding section includes a fluid supply and discharge section that projects from an outer circumference of the annular section and through which the fluid is supplied to and discharged from the annular section.

10. A method for positioning a finger or toe by a positioning device of a drawing apparatus including: a holding case including an insertion section having at least one wall defining a space for receiving a finger or toe inserted therein and an opening through which a nail of the received finger or toe is exposed at a position facing a drawing head section; a holding section located at the space in the holding case and including an annular section having a hollow opening for receiving the finger or toe therein; and a nail placement table in the opening of the holding case and disposed for supporting a tip of the nail thereon, the method comprising supplying a fluid to the annular section when the nail of the finger or toe is exposed at the opening of the holding case and the tip of the nail is supported on the nail placement table, the finger or toe received in the hollow opening faces a specified portion of the inner surface of the annular section so that the annular section expands in generally inward direction in the hollow opening except for the specified portion of the inner surface of the annular section, such that a distance between the nail of the finger or toe at the opening of the holding case and the drawing head section is maintained substantially constant regardless of a diameter of the finger or toe.

11. The method for positioning a finger or toe by a positioning device of a drawing apparatus according to claim 10, wherein when the fluid is supplied to the annular section, the annular section expands in a generally inward direction in the hollow opening except for the specified portion until an inner pressure of the annular section reaches a predetermined value, for circumferentially pressing the finger or toe and suppressing the movement of the finger or toe.

12. The method for positioning a finger or toe by a positioning device of a drawing apparatus according to claim 10, wherein the annular section further comprises a plurality of crushed sections that do not allow for fluid communication therethrough and which are located above an annular center of the annular section, and the annular section further comprises a communication section that does allow for fluid communication therethrough and which is located between the plurality of crushed sections.

13. The method for positioning a finger or toe by a positioning device of a drawing apparatus according to claim 10, wherein the annular section includes an upper portion having the specified portion and a lower portion below the upper portion, and when the fluid is supplied to the annular section, the expansion of the upper portion in the hollow opening is less than the expansion of the lower portion in the hollow opening.

14. The method for positioning a finger or toe by a positioning device of a drawing apparatus according to claim 13, wherein a sheet forming the upper portion of the annular section is less expandable than a sheet forming the lower portion of the annular section.

15. The method for positioning a finger or toe by a positioning device of a drawing apparatus according to claim 10, wherein the holding section includes a support section that supports the annular section to maintain an annular shape of the annular section even in a state where the fluid is not supplied to the annular section.

16. The method for positioning a finger or toe by a positioning device of a drawing apparatus according to claim 10, wherein at least a part of an outer circumferential surface of the annular section is attached to an inner surface of the holding case.

17. The method for positioning a finger or toe by a positioning device of a drawing apparatus according to claim 10, comprising discharging the fluid from the annular section so that the annular section no longer presses the nail of the finger or toe received in the hollow opening of the annular section.

18. The method for positioning a finger or toe by a positioning device of a drawing apparatus according to claim 17, wherein the holding section includes a fluid supply and discharge section that projects from an outer circumference of the annular section and through which the fluid is supplied to and discharged from the annular section.

* * * * *